United States Patent [19]

Wurm

[11] 4,126,493

[45] Nov. 21, 1978

[54] PROCESS FOR DEOXIDATION OF REFRACTORY METALS

[75] Inventor: Jörg Wurm, Kälberau, Germany

[73] Assignee: Deutsche Gold- und Silber-Scheideanstalt vormals Roessler, Frankfurt, Germany

[21] Appl. No.: 385,732

[22] Filed: Aug. 6, 1973

[30] Foreign Application Priority Data

Aug. 18, 1972 [DE] Fed. Rep. of Germany ..... 2240658

[51] Int. Cl.[2] ..... C22F 1/18

[52] U.S. Cl. ..... 148/20; 148/27; 148/133

[58] Field of Search ..... 148/13.1, 20, 27, 133

[56] References Cited

U.S. PATENT DOCUMENTS

| | | | |
|---|---|---|---|
| 2,554,042 | 5/1951 | Mayfield | 148/20 X |
| 2,710,271 | 6/1955 | Fernsler et al. | 148/20 |
| 2,844,499 | 7/1958 | Wainer | 148/20 |
| 2,931,778 | 4/1960 | Ilenda et al. | 148/27 X |
| 2,976,194 | 3/1961 | Commanday et al. | 148/13.1 |
| 3,017,299 | 1/1962 | Carter | 148/20 X |

*Primary Examiner*—R. Dean

*Attorney, Agent, or Firm*—Cushman, Darby & Cushman

[57] ABSTRACT

Refractory metals, especially niobium and tantalum, are deoxidized by heating at 600° to 1300° C. under a protective gas in an alkali or alkaline earth halide salt melt containing at least 10% fluoride.

13 Claims, No Drawings

PROCESS FOR DEOXIDATION OF REFRACTORY METALS

The present invention is directed to the deoxidation of refractory metals, especially the deoxidation of niobium and tantalum by heating in a fluoride containing salt melt under a protective gas.

The high melting refractory metals, as for example, niobium, tantalum, chromium, molybdenum, tungsten or rhenium, absorb gases at high temperatures. For example, they absorb oxygen and fit it into interstices in the crystal lattice. This absorption of gas atoms in the host lattice leads to a considerable change, mostly unfavorable, in the mechanical and physical properties of these metals, especially to embrittlement or a reduction in the electrical conductivity.

Consequently, there has not been a lack of attempts in the past to free these metals again from stored gases, especially by deoxidizing processes. Thus, there have been described and in part also used industrially high vacuum degasification and deoxidation with liquid metals such as calcium, cerium, or magnesium.

The vacuum deoxidation of refractory metals is only possible above a certain boundary temperature at very small pressures for the removal of oxygen in the form of a volatile metal oxide. Below the boundary temperature gas absorption occurs. This boundary temperature is relatively high for several metals, for example, for niobium and tantalum it is at 1600° C. Therefore on an industrial scale the vacuum deoxidation requires a correspondingly large and expensive outlay.

At lower temperatures the deoxidation can be carried out with liquid metals such as calcium, cerium or magnesium under a protective gas. However, in the deoxidation process with liquid metals it is critical that the liquid metal completely wet the part to be treated. Metals possess a relatively large surface tension and, therefore, do not wet very well. A further disadvantage in the deoxidation with metals such as calcium is that the metallic impurities of the calcium diffuse into the refractory metal. In using magnesium the deoxidation temperature can only be used up to 800° C. Cerium cannot be considered for industrial use because of its high price.

It has now been surprisingly found that refractory metals, especially niobium and tantalum can be deoxidized in an especially simple manner to give a product of high purity if the metals are placed in a salt melt of alkali and/or alkaline earth metal halides containing at least 10% of the alkali metal or alkaline earth metal fluoride on a weight basis and heated in a suitable apparatus under protective gas to 600° to 1300° C. Such halides include, LiCl, LiF KCl, KBr, KF, KI, NaCl, NaF, $MgF_2$, $BaF_2$, $SrF_2$, $CaF_2$, $CaCl_2$, $BaCl_2$, $MgCl_2$, $MgBr_2$, $SrCl_2$. Usually the halogen has an atomic weight of 9 to 80 and as stated above, at least 10% of the halide must be fluoride.

As the protective gas there can be used, for example, argon, neon, helium, or other gas inert to the refractory metal.

There is preferably used in the process of the invention a pure alkali and/or alkaline earth fluoride metal for the deoxidation of the refractory metal. Especially preferred is a eutectic melt of LiF-NaF-KF since this mixture has an especially low melting point.

All the refractory oxides react in molten fluorides to a definite extent. Besides the fluorides display an excellent wetting of the metal or oxide surfaces. Therefore, the oxide films on the metals are easily dissolved by fluoride containing melts. After the solution of the surface oxide film there exists a falling concentration gradient to the surface which acts as the driving force for the further deoxidation process of the oxygen dissolved in the interior of the metal.

In fluoride salt melts there are present no elemental metallic impurities which by diffusion can lead to an increase in the impurities in the surface of the metal to be treated. The vapor pressure of the salts used for the deoxidation is lower than that of calcium and magnesium. The salt melts of the invention are also definitely superior to the previously used metals for deoxidation in regard to wettability, elimination of metallic impurities and vapor pressure.

It has proven especially favorable to add up to 20%, e.g., 0.5 to 20%, of a fluoride of a metal to the fourth to seventh side group of the periodic system of the elements (Group IVb, Vb, VIb and VIIb). Thus, there can be used $K_2TaF_7$, $K_2TiF_6$, $K_2ZrF_6$, $K_2NbF_7$, $CrF_3$, $CrF_2$, $MnF_2$, for example. To avoid impurification of the metal to be deoxidized by the metal of the added heavy metal fluoride which can be formed by redox processes in the melt it is recommended to add to the salt melt a fluoride of the metal to be deoxidized. Temperatures of 800 to 1000° C. have proven advantageous.

The process of the invention has the further advantage that the salt melt which after long use is no longer deoxidizingly effective can be regenerated again by treatment with a hydrogen fluoride - hydrogen mixture in the same equipment.

The process of the invention is of special industrial interest for the deoxidizing working up of anodic oxidized tantalum scrap from tantalum condenser plates.

Unless otherwise indicated all parts and percentages are by weight.

The invention is further illustrated in the following examples.

EXAMPLE 1

A niobium sheet measuring 10 mm × 10 mm × 1 mm having an oxygen content of 9200 ppm determined by heat extraction was heated to 1200° C. in a plant under argon protective gas in a melt consisting of 40% NaCl, 35% KCl and 25% KF. After 24 hours of treatment, the oxygen content was only 250 ppm.

EXAMPLE 2

A tantalum sheet measuring 10 mm × 10 mm × 1 mm having an oxygen content of 8400 ppm were heated to 1000° C. under argon in a eutectic melt of 29% LiF, 12% NaF and 59% KF. After 20 hours the oxygen content was only 220 ppm.

EXAMPLE 3

A tantalum alloy as in Example 2 was heated to 800° C. under argon atmosphere in a eutectic melt of LiF/-NaF/KF which also contained 5% $K_2TaF_7$. After 24 hours the oxygen content was only 160 ppm.

While the invention is preferably employed in treating niobium and tantalum, there can also be deoxidized other refractory metals such as, for example, chromium, molybdenum, tungsten or rhenium.

What is claimed is:

1. A process for deoxidation of a refractory metal selected from the group consisting of niobium, tantalum, chromium, molybdenum, tungsten and rhenium comprising heating the metal under an inert protective gas at 600° to 1300° C. in a salt melt consisting essentially of:

(a) an alkali halide or alkaline earth halide, or (b) an alkali halide or alkaline earth halide, together with a fluoride of a metal of Group IVb through VIIb of the periodic system, at least 10% of the salt melt being fluoride.

2. A process according to claim 1 wherein the process consists of heating the metal with said salt bath, the halogen of the alkali halide or alkaline earth halide has an atomic weight of 9 to 80 and at least 10% of the salt melt is fluoride.

3. A process according to claim 1 wherein the refractory metal is niobium or tantalum.

4. A process according to claim 1 wherein the salt melt consists of (a) alkali or alkaline earth fluoride or (b) alkali or alkaline earth fluoride and chloride.

5. A process according to claim 4 wherein the salt melt consists of sodium chloride, potassium chloride and potassium fluoride.

6. A process according to claim 1 wherein the salt melt consists of the alkali or alkaline earth fluoride and a fluoride of a metal of Group IVb through VIIb of the periodic system.

7. A process according to claim 6, wherein the refractory metal is niobium or tantalum.

8. A process according to claim 7 wherein the fluoride is a fluoride of the refractory metal being treated.

9. A process according to claim 8 wherein the salt melt consists of fluorides.

10. A process according to claim 9 wherein there is used as a salt melt 29 parts LiF, 12 parts NaF, 59 parts KF and 5 parts of $K_2TaF_7$.

11. A process according to claim 1 wherein the salt melt consists of alkali or alkaline earth fluoride.

12. A process according to claim 11 wherein the salt melt is the eutectic mixture of LiF, NaF and KF.

13. A process according to claim 6 wherein the temperature is 800° to 1000° C. and the fluoride of the metal of Group IVb to VIIb is a fluoride of the refractory metal being treated.

* * * * *